US009028042B2

(12) United States Patent
Park

(10) Patent No.: US 9,028,042 B2
(45) Date of Patent: May 12, 2015

(54) CAP MEMBER OF LIQUID DISCHARGE HEAD, LIQUID DISCHARGE DEVICE, AND IMAGE FORMING APPARATUS INCLUDING LIQUID DISCHARGE DEVICE

(71) Applicant: Soyoung Park, Kanagawa (JP)

(72) Inventor: Soyoung Park, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/017,486

(22) Filed: Sep. 4, 2013

(65) Prior Publication Data

US 2014/0071200 A1 Mar. 13, 2014

(30) Foreign Application Priority Data

Sep. 13, 2012 (JP) ..... 2012-201553

(51) Int. Cl.
*B41J 2/165* (2006.01)

(52) U.S. Cl.
CPC ..... *B41J 2/16505* (2013.01); *B41J 2/16508* (2013.01)

(58) Field of Classification Search
CPC ..... B41J 2/165; B41J 2/16505
USPC ..... 347/30
See application file for complete search history.

(56) References Cited

U.S. PATENT DOCUMENTS

| | | | | |
|---|---|---|---|---|
| 6,491,370 | B2 * | 12/2002 | Momose | 347/30 |
| 2011/0285783 | A1 * | 11/2011 | Sakata et al. | 347/30 |
| 2012/0056932 | A1 | 3/2012 | Matsubara et al. | |
| 2012/0056933 | A1 | 3/2012 | Tanaka et al. | |
| 2012/0133706 | A1 * | 5/2012 | Park | 347/30 |
| 2012/0133707 | A1 | 5/2012 | Kikkawa et al. | |
| 2012/0224000 | A1 | 9/2012 | Park | |
| 2012/0224001 | A1 | 9/2012 | Park | |
| 2012/0320125 | A1 | 12/2012 | Katoh et al. | |
| 2013/0182036 | A1 | 7/2013 | Park | |

FOREIGN PATENT DOCUMENTS

| | | | |
|---|---|---|---|
| JP | 3-114337 | 11/1991 | |
| JP | H03-114337 | * 11/1991 | B41J 2/165 |
| JP | 4-182142 | 6/1992 | |
| JP | 11-138855 | 5/1999 | |
| JP | 2001-065309 | 3/2001 | |
| JP | 2002-264351 | 9/2002 | |
| JP | 2010-158808 | 7/2010 | |

* cited by examiner

*Primary Examiner* — Alessandro Amari
*Assistant Examiner* — Michael Konczal
(74) *Attorney, Agent, or Firm* — Cooper & Dunham LLP

(57) ABSTRACT

The present invention provides a cap member for a liquid discharge head. The cap member is configured to seal a discharge surface of the liquid discharge head and includes a lower receiving portion; a liquid-absorbing member disposed opposite the discharge surface of the head and including a nozzle-facing surface and a bottom portion; and a suction hole, provided at a bottom of the cap member, through which ink is discharged. In the thus-configured cap member, the bottom portion of the liquid-absorbing member is disposed apart from the lower receiving portion and from the suction hole disposed at the bottom of the cap member, and has a surface slanted toward the suction hole.

9 Claims, 5 Drawing Sheets

CAP MEMBER OF LIQUID DISCHARGE HEAD, LIQUID DISCHARGE DEVICE, AND IMAGE FORMING APPARATUS INCLUDING LIQUID DISCHARGE DEVICE

CROSS-REFERENCE TO RELATED APPLICATION

The present application claims priority pursuant to 35 U.S.C. §119 from Japanese patent application number 2012-201553, filed on Sep. 13, 2012, the entire disclosure of which is incorporated by reference herein.

BACKGROUND

1. Technical Field

The present invention relates to a cap member of a liquid discharge head, a liquid discharge device, and an image forming apparatus including the liquid discharge device.

2. Related Art

Inkjet recording methods using a recording head to discharge ink droplets onto a sheet-like recording medium such as a sheet of paper or a film are well known. The recording device typically employs a cap structure including a cap capable of sealing an ink discharge surface of a head; and an ink-absorbing member capable of absorbing ink discharged or absorbed from the recording head.

The ink is discharged from a plurality of nozzles, the dischargeability of which is degraded due to, for example, drying out. In order to maintain good dischargeability, there are two ways that the cap structure operates: when (1) ink discharge surface is sealed and ink is absorbed from the nozzle, by decreasing the pressure within a sealed space; and (2) the ink discharge surface is not sealed and the recording head is caused forcibly to discharge ink (i.e., a dummy discharge operation).

To reduce the time required to reduce pressure inside the cap, the cap has been made smaller. In addition, dummy discharge performed before, during, and after printing is executed in a state in which the cap is separated from the ink discharge surface, that is, in a state in which the discharge surface is not sealed, to improve productivity.

Further, to facilitate removal of paper jams, allow operators to see the head while cleaning the discharge surface, and prevent smearing of the sheet surface due to ink drops from breakage of the discharge surface meniscus, the discharge surface is sometimes oriented vertically, in a so-called horizontal ink-jetting method. In such a configuration, the cap structure tends to be disposed similarly vertically to simplify the structure and reducing the number of parts used. Dummy discharge is performed in a state in which the cap is closed to prevent leakage of the discharged ink outside the vertically disposed cap.

However, for the purpose of improving printing performance, when dummy discharge is performed by the horizontal jet method in a state in which the cap is separated from the ink discharge surface, the discharged ink is not held inside the cap so that the ink is leaked outside the cap.

The ink leaked outside the cap adheres to the cap nip portion, thereby decreasing a pressure reduction effect inside the cap and degrading the image quality because the leaked ink adheres to the recorded medium via the discharge surface.

JP-2001-65309-A discloses provision of a cap member closely connected to an interior wall of the cap to prevent the ink from leaking from the cap. However, this approach has certain disadvantages, such as an increase in cap size due to addition of the cap member, lengthening of the period of time needed to decrease the pressure in the cap, and increase in the number of parts.

SUMMARY

The present invention provides an improved cap member preventing ink leaks outside the cap when dummy discharge is performed by the horizontal jet method in a state in which the cap is separated from the ink discharge surface. More specifically, the cap member for a liquid discharge head is configured to seal a discharge surface of the liquid discharge head and includes a lower receiving portion; a liquid-absorbing member disposed opposite the discharge surface of the head, in which the liquid-absorbing member includes a nozzle-facing surface and a bottom portion; and a suction hole which is provided at a bottom of the cap member and through which ink is discharged. Further, in the-thus configured cap member, the bottom portion of the liquid-absorbing member is apart from the lower receiving portion and from the suction hole disposed at the bottom of the cap member, and has a surface slanted toward the suction hole. The present invention also provides a liquid discharge device including the cap member, and an image forming apparatus including the liquid discharge device.

These and other objects, features, and advantages of the present invention will become apparent upon consideration of the following description of the preferred embodiments of the present invention when taken in conjunction with the accompanying drawings.

DETAILED DESCRIPTION

Hereinafter, preferred embodiments of the present invention will now be described with reference to accompanying drawings.

Figure 1:
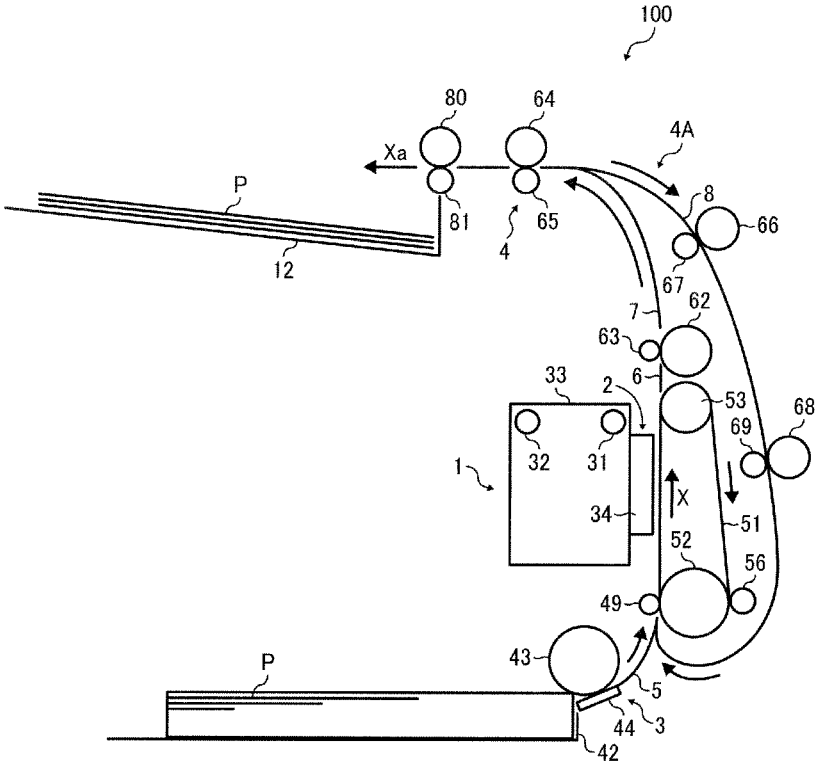
FIG. 1 is a cross-sectional view of an inkjet printer as an exemplary image forming apparatus according to an embodiment of the present invention.
Figure 2:
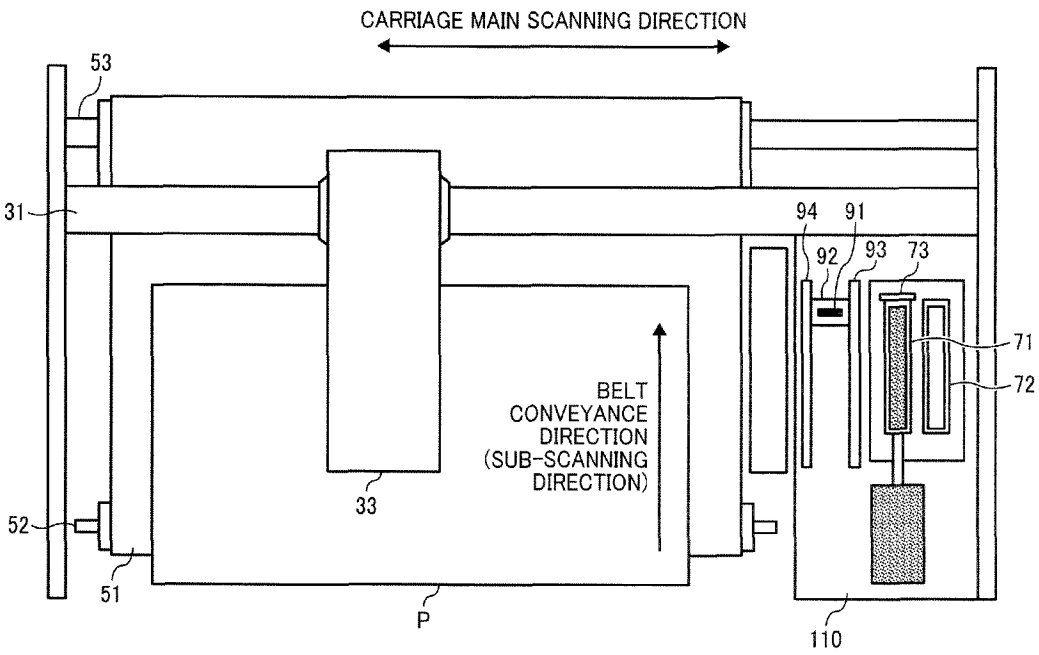
FIG. 2 is a schematic view of the ink jet printer of FIG. 1 illustrating a structure of an image forming section thereof.

FIG. 1 is a cross-sectional view of an inkjet printer 100 as an example of an image forming apparatus according to an embodiment of the present invention. FIG. 2 is a side view of the ink jet printer 100 of FIG. 1 illustrating a structure of an image forming section thereof.

The image forming apparatus illustrated in FIGS. 1 and 2 is a serial-type image forming apparatus and includes an image forming section 1 performing image formation using an inkjet method; a conveyance section 2 to convey a sheet P; sheet feed section 3 feeding and conveying the sheet P; and a sheet discharging and reversing section 4 including a sheet discharging portion and a reversing portion 4A to reversely convey the single-sided printed sheet P.

The present inkjet printer 100 includes a sheet conveyance path 5 to convey the sheet P from the sheet feed section 3 to the conveyance section 2, a common conveyance path 6, a curved conveyance path 7, and a reverse conveyance path 8. The common conveyance path 6 is connected to the sheet conveyance path 5, and is a path to convey the single-sided printed sheet, that is, the sheet of which a front surface or a first side has been printed, and a duplex printed sheet, that is, a sheet printed on both sides after reversing the single-sided printed sheet downstream of the image forming section 1. The curved conveyance path 7 is connected to the common conveyance path 6 and is shaped to change a conveyance direction of the single-sided printed sheet or the duplex printed sheet. The reverse conveyance path 8 is connected to the curved conveyance path 7 and is disposed at the reversing portion 4A to reverse and convey the single-sided printed sheet to the image forming section 1 and the conveyance section 2 again.

The image forming section 1 includes a movable carriage 33 that scans. Main and auxiliary guide rods 31, 32 laterally extending in the apparatus body are fixed to the apparatus. Via these guide rods 31, 32, the carriage 33 is held slidably relative to the main scanning direction. The carriage 33 is connected to a main scanning motor via a timing belt and reciprocally moves to scan in the main scanning direction driven by the main scanning motor, not shown.

A recording head 34 is formed of liquid discharge heads to discharge ink droplets of each color of yellow (Y), cyan (C), magenta (M), and black (K). The recording heads 34 are mounted on the carriage 33. The recording head 34 includes nozzle arrays formed of a plurality of nozzles arranged in a sub-scanning direction (Arrow X direction in FIG. 1) perpendicular to the main scanning direction, with the ink droplet discharge head directed horizontally.

The recording head 34 includes four nozzle arrays, each of which discharges droplets of black (K), cyan (C), magenta (M), and yellow (Y).

The carriage 33 includes head tanks, not shown, which supply ink of respective colors corresponding to each nozzle array of the recording head 34. The head tanks are supplied with a recording liquid of respective colors via a supply tube of each color by a supply pump unit from each recording liquid cartridge detachably mounted to the cartridge mount portion.

The sheet feeding section 3 includes a sheet tray 42 on which a plurality of sheets P is stacked, a sheet feed roller 43 to feed the sheet P on the sheet feed tray 42, and a separation pad 44 to separate and convey each sheet P from the stacked sheets in collaboration with the sheet feed roller 43. The separation pad 44 is disposed opposite the sheet feed roller 43 to separate and convey each sheet P from the stacked sheets and is formed of a material having a high friction coefficient. The separation pad 44 is pressed against the sheet feed roller 43.

The present inkjet apparatus includes the sheet conveyance path 2 to convey the sheet P sent from the sheet feed section 3 or the single-sided printed sheet P reversely sent for the duplex printing, to a position opposite the recording head 34 of the image forming section 1. The conveyance section 2 includes a pressure roller 49, a conveyance belt 51, and a charging roller 56. The pressure roller 49 presses a surface of the conveyance belt 51.

The conveyance belt 51 electrostatically attracts and sends the conveyed sheet P to the position opposite the recording head 34 and serves as a conveyance means to send the sheet P toward the sheet conveyance direction X intermittently. The conveyance belt 51 is an endless belt entrained around a conveyance roller 52 and a tension roller 53, and is so configured as to rotate in a belt conveyance direction X, which is the same direction as the sub-scanning direction.

In addition, a charging roller 56, which is a charging means to charge a surface of the conveyance belt 51, is provided. The charging roller 56 is disposed in contact with an insulated surface layer of the conveyance belt 51 and is rotated by the rotation of the conveyance belt 51. The conveyance belt 51 is rotated, via the not-shown timing belt serving as the drive transmitter, in the belt conveyance direction as indicated by an arrow by the rotation of the conveyance roller 52 which is driven by the sub-scanning motor, not shown.

The conveyance belt 51 is of a single layer structure or plural layer structure and includes a surface layer contacting the sheet or the charging roller 56 which is formed of at least an insulation layer formed of resins such as: polyethylene terephthalate (PET), polyetherimide (PEI), polyvinylidene fluoride (PVDF), polycarbonate (PC), ethylene tetrafluoroethylene (ETFE), polytetrafluoroethylene (PTFE), and the like or an elastomer without conductivity control materials. Further, when the insulation layer of the conveyance belt 51 includes a plurality of layers, a side not contacting the charging roller 56 may include a conductive layer containing the above resins or elastomer mixed with carbon.

At that time, an alternate voltage, which is an alternating repetition of positive and negative charges, is applied to the charge roller 56. Thus, the conveyance belt 51 is charged in an alternating charge pattern, in which strips of positive and negative charges alternate in the sub-scanning direction X, which is the rotary direction of the conveyance belt 51. When the sheet P is fed on the thus-alternately-charged conveyance belt 51, the sheet P is attracted by the conveyance belt 51 and is conveyed in the sub-scanning direction X by the rotary movement of the conveyance belt 51.

Then, a control means, not shown, drives the recording heads 34 in response to image signals while moving the carriage 33 so as to discharge ink droplets onto the stopped sheet P to record a single line. After the sheet P is conveyed by the conveyance belt 51 by a predetermined distance, recording of a next line is performed.

Upon the not-shown control means receiving a recording end signal or a signal indicating that a trailing edge of the sheet P has passed a printing area 10 being a recording area of the recording heads 34, the recording operation is terminated and the sheet P is ejected onto the sheet discharge tray 12.

Further, the present inkjet printer 100 includes a sheet discharge section to discharge sheet on which images have been formed and recorded by the recording heads 34, including a conveyance roller 62 and a spur 63 as a conveyance roller. The conveyance roller 62 sends the separated sheet P from the conveyance belt 51 to a sheet discharging and reversing section 4. The conveyance roller 62 and the spur 63 form a nip position along an extended line of the conveyance belt 51 so that image formation or recording precision to the sheet surface opposed to the recording heads 34 is not adversely affected when the leading end of the sheet P after image formation enters into the nip between the conveyance roller 62 and the spur 63. The conveyance roller 62 and the spur 63 include a conveyance force to fully convey the sheet P to the curved conveyance path 7 without the trailing end of the sheet P being remained between the nip position between the conveyance roller 62 and the spur 63 after sandwiching the sheet P between the conveyance roller 62 and the spur 63, so that the sheet surface opposed to the recording head 34 is not affected with regard to the image formation and recording precision.

The sheet discharging and reversing section 4 includes a first sheet discharge roller pair 64, 65 (more specifically, a first discharge roller 64 and a spur 65) and a second discharge roller pair 80, 81 (more specifically, a second discharge roller 80 and a spur 81) disposed downstream of the first sheet discharge roller pair 64, 65. One of the first sheet feed rollers 64 and one of the second sheet discharge rollers 80 can rotate both clockwise and counterclockwise.

A sheet discharge tray 12 to stack the sheet P discharged by the second sheet discharge roller 80 and the spur 81 is disposed at the most downstream of the sheet discharge direction Xa.

A branching claw, not shown, is disposed at a branching portion between the curved conveyance path 7 of the sheet discharging and reversing section 4 and the reverse conveyance path 8. The reverse conveyance path 8 includes reverse rollers 66, 68, and spurs 67, 69. The sheet P one side of which has been printed is conveyed by the reverse roller pairs 66, 67 and 68, 69 along the reverse conveyance path 8, and again is conveyed between the conveyance belt 51 and the pressure roller 49 via the reverse roller pair 68, 69.

A cleaning device performs recovery of nozzles of the recording heads 34 and wetting of the nozzles when the printer is suspended. In the example illustrated in FIG. 2, the cleaning device is disposed on the right side of the printer. The cleaning device is provided with a frame 110 fixed at a right side plate with screws. The frame 110 includes a stepping motor for capping, not shown. The frame 110 further includes a suction cap 71, a wetting cap 72, and a head guide portion 73 of a cap holder. When the stepping motor for capping is normally driven, the head guide portion 73, the suction cap 71, and the wetting cap 72 perform capping and uncapping operation via a gear and a cam, both not shown. When the stepping motor for capping is reversely driven, a tubing pump pumps.

A wiper blade 91 is fixed to a wiper blade holder 92. The wiper blade holder 92 includes projections at lateral sides thereof in a direction perpendicular to a wiping direction. The projections each enter into grooves of wiping guides 93, 94. The grooves of the wiping guides 93, 94 are formed along the wiping direction by the wiper blades, that is, in the vertical direction in the present structure, and the grooves are longer than the wiping range of the wiper blade 91. In addition, the wiper blade holder 92 includes a rack structure and is connected to a stepping motor for wiping, not shown. Due to the normal and reverse driving of the stepping motor, the wiper blade is allowed to move vertically to wipe a discharge surface of the nozzles.

Figure 3A:
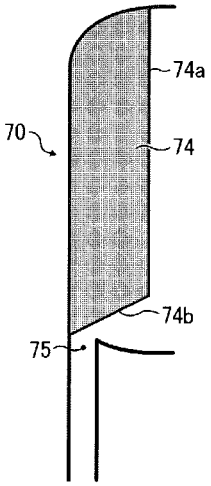
FIGS. 3A to 3C each are views of a cap member according to a first embodiment illustrating a structure and effect thereof.
Figure 3B:
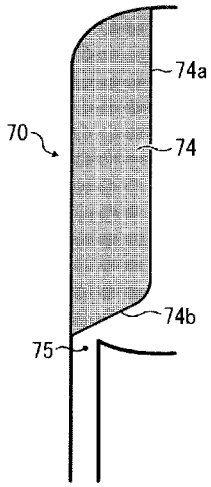
Figure 3C:
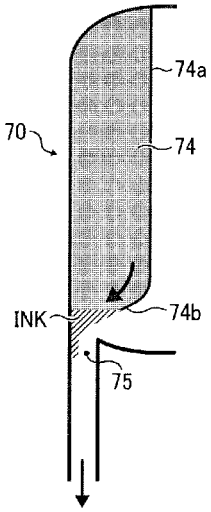

FIGS. 3A to 3C each are views of a cap member according to a first embodiment of the present invention illustrating a structure and effect thereof.

As illustrated in FIGS. 3A to 3C, a cap member 70, which can be used as the suction cap 71 and the wetting cap 72 in FIG. 2, includes a liquid-absorbing member 74 in its case thereof, and is so disposed as to oppose to a discharge surface of the discharge head, not shown. A fibrous material may be used for the liquid-absorbing member 74. The fibrous material includes an internal space and absorbs a liquid such as ink in its internal space. In the present embodiment, a hard fibrous material is used. The liquid-absorbing member 74 is fixed to a distal wall (i.e., a left-side wall in FIGS. 3A to 3C) of the cap member with a double-sided tape or an adhesive agent.

A suction hole 75 through which ink is discharged is provided at a bottom of the cap member 70. The suction hole 75 is connected to a suction pump via a tube. The open side of the cap member 70 (right side in the figure) is a side opposite the nozzle of the discharge head. Ink droplets discharged from the nozzle on the right side toward the left side are received by the nozzle-facing surface (that is, the right side surface in the figure) of the liquid-absorbing member 74.

As illustrated in FIG. 3A, a boundary between a nozzle-facing surface 74*a* and a bottom portion 74*b* of the liquid-absorbing member 74 has a corner angle. As illustrated in FIG. 3B, the boundary between the nozzle-facing surface 74*a* and the bottom portion 74*b* of the liquid-absorbing member 74 has a curved surface. It is preferred that the length of the nozzle-facing surface 74*a* of the liquid-absorbing member 74 be longer than that of the nozzle arrays of the heads.

In the cap member 70 according to the present invention, the bottom portion 74*b* of the liquid-absorbing member 74 is formed as a curved surface slanting toward the suction hole 75. Hereinafter, the bottom portion 74*b* is defined as a slanted surface 74*b*. The bottom end of the slanted surface 74*b* is set apart from the suction hole 75 so as not to clog up the suction hole 75. In addition, the liquid-absorbing member 74 or the slanted surface 74*b* is disposed apart from the bottom of the case of the cap member.

FIG. 3C shows a flow of the ink received by the cap member 70 in the dummy discharging. The ink jetted from the discharge head, not shown, from the discharge head capped by the cap member 70 is received by the liquid-absorbing member 74 and is absorbed therein.

The thus-absorbed ink moves gradually downward in the liquid-absorbing member 74 under its own weight, and as shown by a bold arrow, is collected above the suction hole 75 and drops therefrom into the suction hole 75. The suction pump is also driven when the dummy discharge is operated, and the ink that has flown into the tube from the suction hole 75 is sent to a waste tank, not shown. Because the ink leaked from the liquid-absorbing member 74 is delivered to the waste tank by driving the suction pump, the amount of ink remaining in the cap member 70 is small, thereby preventing the ink from leaking from the cap. The above description is of a case like that illustrated in FIG. 3B, but even in the cap member 70 of FIG. 3A, the same operation is performed.

The bottom surface of the liquid-absorbing member 74 is disposed apart from the bottom of the case of the cap member and from the suction hole 75 or the ink discharging port. Because the move of the ink along the slanted surface 74*b* is slower than the vertical move or dropping, when the liquid-absorbing member contacts the bottom of the case, the ink leaks outside from the liquid-absorbing member before it flows into the suction hole 75 or the ink discharging port. In addition, when the liquid-absorbing member clogs up the suction hole 75, minute bubbles in the absorbable member are absorbed by the suction hole 75, and the bubbles do not disappear easily but remain in the suction hole, which is an obstacle to discharging ink.

A second embodiment solves the above-described problem.

Figure 4A:
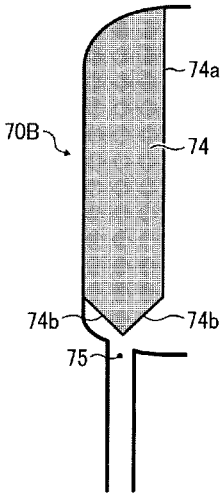
FIGS. 4A and 4B are cross-sectional views of a cap member according to a second embodiment of the present invention.
Figure 4B:
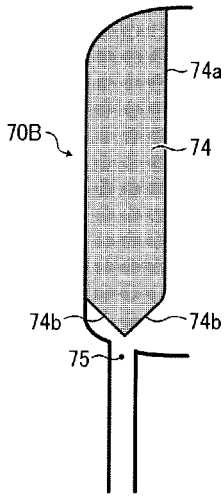

FIGS. 4A and 4B are views of the cap member according to a second embodiment.

As illustrated in FIGS. 4A and 4B, a cap member 70B, which can be used as the suction cap 71 and the wetting cap 72 in FIG. 2, is configured such that a position of the suction hole 75 is different from that of the cap member 70 in FIG. 3. Specifically, the cap member 70 in the first embodiment includes the suction hole 75 positioned at the distal end of the cap member 70 along the distal wall surface. However, in the cap member 70B according to the second embodiment, the suction hole 75 is disposed at a position slightly advanced from the distal wall surface of the cap member 70B.

In addition, in the cap member 70B according to the second embodiment, a shape of the liquid-absorbing member 74 is different from that of the cap member 70 according to the first embodiment. In the second embodiment, two slanted surfaces 74*b*, 74*b* are formed at bottom surfaces of the liquid-absorbing member 74. Two slanted surfaces include specifically a slanted surface slanted from a front of the liquid-absorbing member 74 or the nozzle-facing surface 74*a* to the suction hole 75 and another slanted surface slanted from the rear side of the liquid-absorbing member 74 toward the suction hole 75. In the second embodiment, a leading end of the lower slanted surface of the liquid-absorbing member 74 is positioned at a position corresponding to the suction hole 75, so as to correspond to the positioned of the suction hole 75 displaced toward the front. The bottom end of the slanted surface 74*b*, 74*b* is apart from the suction hole 75 so as not to clog up the suction hole 75. In addition, the liquid-absorbing member 74 or the slanted surface 74*b* is disposed apart from the bottom of the case of the cap member.

As illustrated in FIG. 4A, the boundary between the nozzle-facing surface 74*a* and the front slanted surface 74*b* of the liquid-absorbing member 74 has a corner angle. As illustrated in FIG. 4B, the boundary between the nozzle-facing surface 74*a* and the front slanted surface 74*b* of the liquid-absorbing member 74 has a curved surface.

The structure and operation of the second embodiment other than that described here are identical to those of the cap member 70 according to the first embodiment.

The ink jetted from the discharge head, not shown, capped by the cap member 70B is received by the liquid-absorbing member 74 and is absorbed therein. The thus-absorbed ink moves gradually downward in the liquid-absorbing member 74 under to its own weight, and is collected above the suction hole 75 along the slanted surface 74*b*, 74*b* and drops therefrom into the suction hole 75. The suction pump is also driven when the dummy discharge is operated, and the ink that has flown into the flow path such as the tube from the suction hole 75 is sent to a waste tank, not shown. Because the ink leaked from the liquid-absorbing member 74 is sent to the waste tank by driving the suction pump, the amount of ink remaining in the cap member 70B is less, thereby preventing the ink from leaking from the cap.

Figure 5A:
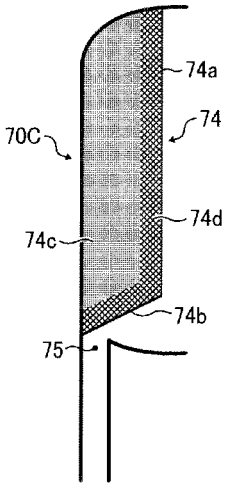
FIGS. 5A and 5B are cross-sectional views of a cap member according to a third embodiment.
Figure 5B:
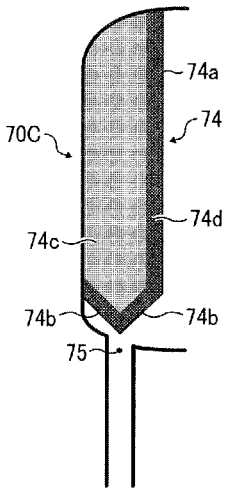

FIGS. 5A and 5B are views of the cap member according to a third embodiment.

A cap member 70C according to the third embodiment, which can be used as the suction cap 71 and the wetting cap 72 in FIG. 2, is configured such that a density of a front portion of the liquid-absorbing member 74 (disposed as a jetted ink receiving portion) and of a lower portion (which is a portion disposed as a slanted surface opposed to the suction hole 75) is larger (or rougher) than that of the body of the liquid-absorbing member 74.

FIG. 5A corresponds to a structure according to the first embodiment described with reference to FIG. 3A and FIG. 5B corresponds to a structure according to the second embodiment described with reference to FIG. 4A.

In the above structures in FIGS. 5A and 5B, a boundary portion between the nozzle-facing surface 74*a* and the slanted surface 74*b* is formed as an angled corner. But the same description will be applied to a case in which the boundary portion is a curved surface.

As illustrated in FIGS. 5A and 5B, the nozzle-facing surface 74*a* and the slanted surface 74*b* of the liquid-absorbing member 74 include a low-density portion 74*d*, which is an area from the surface of the liquid-absorbing member 74 to a predetermined depth. The low-density portion 74*d* has a lower density than that of a main portion 74*c* of the liquid-absorbing member 74. In the present embodiment, because the liquid-absorbing member 74 employs a fibrous material, the density of the fiber in the low-density portion 74*d* is rougher than that in the main portion 74*c*. When a material other than the fibrous material is used, similarly, the area from the surface of the nozzle-facing surface 74*a* and the slanted surface 74*b* to a predetermined depth thereof is configured to have a low density.

Because the low-density portion 74*d* includes material having a lower density than the density of the main body, the jetted ink via the dummy discharge tends to move downward and the ink is collected at the bottom of the liquid-absorbing member 74 more quickly and flows to the suction hole 75 swiftly. The ink is sucked up by the suction pump and is sent to the waste tank, thereby preventing the ink from remaining in the cap member 70C and leaking from the cap.

Although the nozzle-facing surface 74*a* of the liquid-absorbing member 74 alone may be formed as the low-density area, both the nozzle-facing surface 74*a* and the slanted surface 74*b* are preferably formed as the low-density areas because the ink leaking can be prevented from the boundary portion between the both areas.

Figure 6:
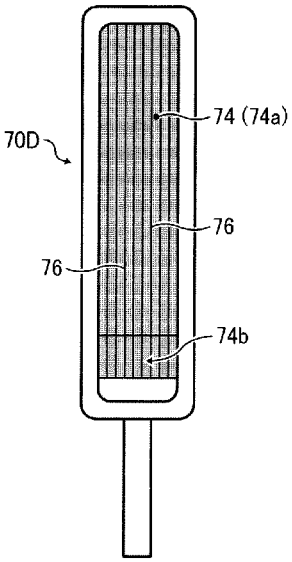
FIG. 6 is a front view of a cap member according to a fourth embodiment of the present invention.

FIG. 6 is a front view of a cap member as a fourth embodiment of the present invention.

A cap member 70D according to the fourth embodiment (which can be used as the suction cap 71 and the wetting cap 72 in FIG. 2) includes vertical slit-like grooves 76 on the nozzle-facing surface 74*a* and the slanted surface 74*b* of the liquid-absorbing member 74. The structure other than what is described here is identical to the cap members 70, 70B according to the first and second embodiments. Although the cap member 70B according to the second embodiment includes two slanted surfaces 74*b*, at least the front side slanted surface 74*b* includes the slit-like grooves 76.

A single slit-like groove 76 can be provided, but a plurality of grooves 76 with a small width is preferable. Further, the groove positions preferably correspond to the nozzle arrays.

Because the cap member 70D of the fourth embodiment enables the ink received from the dummy discharge to flow downward along the grooves 76, the ink is collected at the lower end of the liquid-absorbing member 74 more quickly and flows to the suction hole 75 swiftly. The ink is sucked up by the suction pump and is sent to the waste tank, thereby preventing the ink from remaining in the cap member 70D and leaking from the cap.

Figure 7:
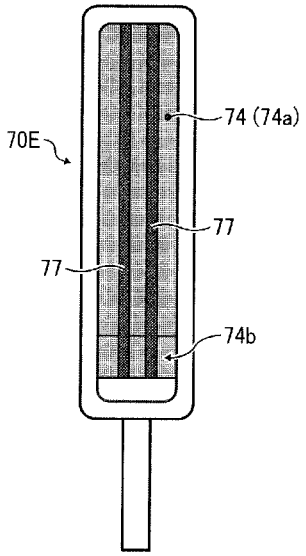
FIG. 7 is a front view of a cap member according to a fifth embodiment of the present invention.

FIG. 7 is a front view of the cap member according to a fifth embodiment of the present invention.

A cap member 70E according to the fifth embodiment (which can be used as the suction cap 71 and the wetting cap 72 in FIG. 2) includes vertical unabsorbable portions 77 in the nozzle-facing surface 74*a* and the slanted surface 74*b* of the liquid-absorbing member 74. The structure other than what is described above is identical to the cap members 70, 70B according to the first and second embodiments referring to FIGS. 3 and 4. Although the cap member 70B according to the second embodiment includes two slanted surfaces 74*b*, at least the front side slanted surface 74*b* includes the unabsorbable portions 77.

One or a plurality of unabsorbable portions 77 can be provided. In FIG. 7, two unabsorbable portions 77 are disposed. Further, the unabsorbable portions 77 preferably position corresponding to the nozzle arrays of the liquid discharge head. Furthermore, water-repellent property can be added to a surface of the unabsorbable portions 77.

Because the cap member 70E of the fifth embodiment enables the ink received from the dummy discharge to flow downward along the unabsorbable portions 77, the ink is collected at the lower end of the liquid-absorbing member 74 more quickly and flows to the suction hole 75 swiftly. The ink is sucked up by the suction pump and is sent to the waste tank, thereby preventing the ink from remaining in the cap member 70E and leaking from the cap.

In place of the unabsorbable portions 77 which do not absorb a liquid, provision of a poorly absorbable member can obtain the same effect. Furthermore, water-repellent property can be added to a surface of the poorly absorbable member. Further, the unabsorbable portions 77 or the poorly absorbable member are preferably disposed at positions opposed to the nozzle arrays of the discharge head in the same number. In the present embodiment, the unabsorbable portions 77 or the poorly absorbable member are disposed in two rows.

Figure 8A:
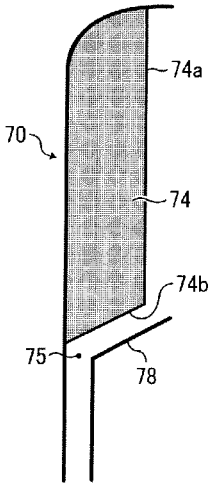
FIGS. 8A to 8C are cross-sectional views of a cap member according to a sixth embodiment.
Figure 8B:
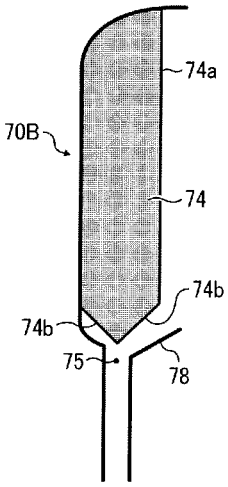
Figure 8C:
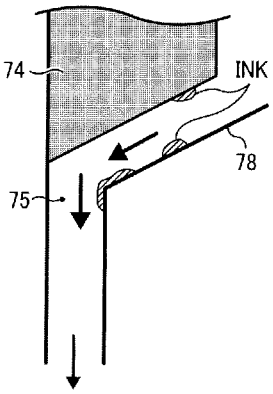

FIGS. 8A to 8C are cross-sectional views of the cap member according to a sixth embodiment of the present invention.

A cap member 70, which can be used as the suction cap 71 and the wetting cap 72 of FIG. 2, is configured such that the lower receiving portion 78 of the cap member is gradually slanting from front to rear side. Because the slanted structure of the lower receiving portion 78 can be applied to the cap members of the above-described first to fifth embodiments, the cap member is applied with the same reference numbers 70, 70B as in FIGS. 8A and 8B. Specifically, as illustrated in FIG. 8A, the cap member 70 according to the first embodiment is applied with the structure according to the sixth embodiment. In addition, as illustrated in FIG. 8B, the cap member 70B according to the second embodiment is applied with the structure according to the sixth embodiment. The other cap members according to other embodiments can be applied with the structure according to the sixth embodiment.

As illustrated in an exploded view of FIG. 8C, the cap member applied with the structure of the sixth embodiment shows that even though the ink leaks from the liquid-absorbing member 74 at a position other than the suction hole 75, the leaked ink is received by the lower receiving portion 78 and flows toward the suction hole 75 along the slant of the lower receiving portion 78. The ink flowing to the suction hole 75 is sucked up by the suction pump and is sent to the waste tank, thereby preventing the ink from remaining in the cap member 70 and leaking from the cap.

The slanted angle of the lower receiving portion 78 can be arbitrary set, and the slant that is steeper is more preferable, because the ink can be flown more swiftly. The slanted surface of the lower receiving portion 78 can be set parallel to the slanted surface 74*b* of the liquid-absorbing member 74.

Even when the dummy discharge is frequently performed due to the use environment or the stand-by time of the image forming apparatus and the amount of ink exceeds the allowable limit of the liquid-absorbing member 74 of the cap member and the ink leaks outside, the leaked ink inside the cap member can be introduced to the suction hole 75, thereby securely preventing the ink from leaking from the cap member.

Heretofore, the present invention has been described with reference to drawings, but is not limited to the aforementioned embodiments alone. In the above-described embodiments, the 'liquid' is not limited to so-called ink, but means and is used as an inclusive term for every material having a fluid state when discharged. In addition, the 'liquid discharging device' means a device to discharge a liquid from the liquid discharge head and is not limited to an apparatus to perform image formation or image recording. The structure of the discharge head is also arbitrary. The structure of jetting ink can also be applied with an arbitrary method.

As a liquid absorbing material provided in the cap member, any material can be applied appropriately without limiting to the fibrous material as described in the illustrated examples. The structure of the cap member such as the cap case may be modified within the scope of the present invention.

The number of the colors for ink can also be arbitrary not limiting to four in the image forming apparatus provided with the liquid discharging device according to the present invention. The present invention can be applied to a line-type inkjet recording apparatus without limiting to the serial-type recording apparatus.

Additional modifications and variations of the present invention are possible in light of the above teachings. It is therefore to be understood that, within the scope of the appended claims, the invention may be practiced other than as specifically described herein.

What is claimed is:

1. A cap member for a liquid discharge head, configured to seal a discharge surface of the liquid discharge head, comprising:

a lower receiving portion;

a liquid-absorbing member disposed opposite the discharge surface of the head, the liquid-absorbing member including a nozzle-facing surface and a bottom portion; and a suction hole, provided at a bottom of the cap member, through which ink is discharged, wherein the bottom portion of the liquid-absorbing member is disposed apart from the lower receiving portion and from the suction hole disposed at the bottom of the cap member, and has a surface slanted toward the suction hole, wherein the liquid-absorbing member includes portions having little or no liquid absorption on the nozzle-facing surface opposite the discharge surface of the head.

2. The cap member as claimed in claim 1, further comprising:

a first slanted surface slanted from a front of the liquid-absorbing member toward the suction hole; and a second slanted surface slanted from a rear side of the liquid-absorbing member toward the suction hole.

3. The cap member as claimed in claim 1, wherein the nozzle-facing surface and the slanted surface of the liquid-absorbing member include a portion of reduced density extending from a surface thereof up to a predetermined depth thereof.

4. The cap member as claimed in claim 1, wherein the portion having little or no liquid absorption is water-repellent.

5. The cap member as claimed in claim wherein there are equal numbers of portions having little liquid absorption and portions having no liquid absorption.

6. The cap member as claimed in claim 1, further comprising a case of the cap member, wherein the lower receiving portion disposed in the case of the cap member slants from a side opposite the head toward the suction hole.

7. A liquid discharge device comprising the cap member as claimed in claim 1.

8. An image forming apparatus comprising:

a liquid discharge head; and the liquid discharge device as claimed in claim 7.

9. The image forming apparatus as claimed in claim 8, further comprising a suction pump, wherein the suction pump is driven when the liquid discharge head performs a dummy discharging operation.

* * * * *